US011325380B2

(12) United States Patent
Kornilovich et al.

(10) Patent No.: US 11,325,380 B2
(45) Date of Patent: May 10, 2022

(54) DROPLET EJECTORS TO PROVIDE FLUIDS TO DROPLET EJECTORS

(71) Applicant: HEWLETT-PACKARD DEVELOPMENT COMPANY, L.P., Spring, TX (US)

(72) Inventors: Pavel Kornilovich, Corvallis, OR (US); Alexander Govyadinov, Corvallis, OR (US); John Lahmann, Corvallis, OR (US); Paul J. Benning, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,255

(22) PCT Filed: Jul. 17, 2018

(86) PCT No.: PCT/US2018/042411

§ 371 (c)(1),
(2) Date: Oct. 15, 2019

(87) PCT Pub. No.: WO2020/018074

PCT Pub. Date: Jan. 23, 2020

(65) Prior Publication Data

US 2021/0331468 A1 Oct. 28, 2021

(51) Int. Cl.
*B41J 2/14* (2006.01)
*B41J 2/175* (2006.01)

(52) U.S. Cl.
CPC ..... *B41J 2/1433* (2013.01); *B41J 2/17553* (2013.01)

(58) Field of Classification Search
CPC ..... B41J 2/1433; B41J 2/17553; B41J 2/211; B41J 2/2114
See application file for complete search history.

(56) References Cited

U.S. PATENT DOCUMENTS 4,329,698 A 5/1982 Smith
4,614,953 A * 9/1986 Lapeyre ..... B41J 2/025 347/43

(Continued)

FOREIGN PATENT DOCUMENTS

CA 2970491 A1 6/2016
EP 0470202 B1 6/1994

(Continued)

OTHER PUBLICATIONS

D. Wallace et al. "Ink-Jet as a MEMs Manufacturing Tool"; Micro Fab Technologies.

(Continued)

*Primary Examiner* — Jason S Uhlenhake
(74) *Attorney, Agent, or Firm* — Thorpe North & Western LLP

(57) ABSTRACT

An example device includes a first droplet ejector including a first nozzle to eject droplets of a first fluid, and a first target medium positioned relative to the first droplet ejector to receive the droplets of the first fluid from the first droplet ejector. The example device further includes a second droplet ejector in fluid communication with the first target medium to receive a second fluid from the first target medium. The second droplet ejector includes a second nozzle to eject droplets of the second fluid.

12 Claims, 7 Drawing Sheets

(56) References Cited

U.S. PATENT DOCUMENTS

| | | | | |
|---|---|---|---|---|
| 4,877,745 | A | 10/1989 | Hayes et al. | |
| 5,032,850 | A | 7/1991 | Andeen et al. | |
| 5,587,128 | A | 12/1996 | Wilding et al. | |
| 5,892,524 | A | 4/1999 | Silverbrook | |
| 6,432,694 | B1 | 8/2002 | Malmqvist | |
| 6,450,775 | B1 | 9/2002 | Hutchinson et al. | |
| 7,125,447 | B2 | 10/2006 | Sugita et al. | |
| 7,179,423 | B2 | 2/2007 | Bohm et al. | |
| 7,456,012 | B2 | 11/2008 | Ryttsen et al. | |
| 7,763,453 | B2 | 7/2010 | Clemmens et al. | |
| 8,158,083 | B2 | 4/2012 | Krug et al. | |
| 8,287,112 | B2 | 10/2012 | Thillo et al. | |
| 8,308,339 | B2 | 11/2012 | Karpetsky et al. | |
| 8,426,209 | B2 | 4/2013 | Butler et al. | |
| 8,697,009 | B2 | 4/2014 | Saltsman et al. | |
| 8,746,285 | B2 | 6/2014 | Wook et al. | |
| 8,894,761 | B2 | 11/2014 | Birecki et al. | |
| 9,138,714 | B2 | 9/2015 | Samper et al. | |
| 9,410,977 | B2 | 8/2016 | Stone et al. | |
| 9,523,013 | B2 | 12/2016 | Reboa | |
| 9,663,819 | B2 | 5/2017 | Jovanovich et al. | |
| 2001/0016322 | A1 | 8/2001 | Caren et al. | |
| 2002/0092767 | A1 | 7/2002 | Bjornson et al. | |
| 2002/0127736 | A1 | 9/2002 | Chou et al. | |
| 2002/0153251 | A1 | 10/2002 | Sassi et al. | |
| 2003/0180449 | A1 | 9/2003 | Wiktorowicz et al. | |
| 2005/0106066 | A1 | 5/2005 | Saltsman et al. | |
| 2006/0244799 | A1* | 11/2006 | Sasa | B41J 2/16523 347/89 |
| 2007/0035579 | A1 | 2/2007 | Bibl et al. | |
| 2007/0111303 | A1 | 5/2007 | Inoue et al. | |
| 2008/0114225 | A1 | 5/2008 | Rabinovitz | |
| 2008/0252679 | A1 | 10/2008 | Pierik et al. | |
| 2009/0130745 | A1 | 5/2009 | Williams et al. | |
| 2009/0148933 | A1 | 6/2009 | Battrell et al. | |
| 2010/0143905 | A1 | 6/2010 | Lane et al. | |
| 2010/0214383 | A1 | 8/2010 | Silverbrook et al. | |
| 2011/0064613 | A1 | 3/2011 | Chen | |
| 2011/0143968 | A1 | 6/2011 | Chen et al. | |
| 2012/0115738 | A1 | 5/2012 | Zhou et al. | |
| 2014/0051604 | A1 | 2/2014 | Davies et al. | |
| 2015/0273470 | A1 | 10/2015 | Hoffmann | |
| 2015/0298119 | A1 | 10/2015 | Williams et al. | |
| 2016/0175864 | A1 | 6/2016 | Bloc | |
| 2016/0341337 | A1 | 11/2016 | Govyadinov et al. | |
| 2017/0165972 | A1* | 6/2017 | Lee | B41J 2/17506 |
| 2017/0205438 | A1 | 7/2017 | Peters | |
| 2018/0015473 | A1 | 1/2018 | Bharadwaj et al. | |
| 2018/0017175 | A1 | 1/2018 | Liang et al. | |
| 2018/0030515 | A1 | 2/2018 | Regev et al. | |
| 2018/0052082 | A1 | 2/2018 | Groll et al. | |

FOREIGN PATENT DOCUMENTS

| | | | |
|---|---|---|---|
| EP | 0990525 | B1 | 8/2006 |
| JP | 5007016 | B2 | 8/2012 |
| KR | 20110035113 | A | 4/2011 |
| WO | WO1997011133 | A1 | 3/1997 |
| WO | WO2008024319 | A2 | 2/2008 |
| WO | WO2011094577 | A3 | 11/2011 |
| WO | WO2013135878 | A1 | 9/2013 |
| WO | WO2013176767 | A1 | 11/2013 |
| WO | WO2016175864 | A1 | 11/2016 |
| WO | WO2017091213 | A1 | 6/2017 |
| WO | WO2017180660 | A1 | 10/2017 |

OTHER PUBLICATIONS

Li Baoqing et al., "Piezoelectric-driven droplet impact printing with an interchangeable microfluidic cartridge", Sep. 1, 2015, Biomicrofluidics 9, 054101.

Liu Robin et al., Self-contained, fully integrated biochip for sample preparation, Polymerase Chain Reaction Amplification, and DNA Microarray Detection, Feb. 25, 2004, Analitical Chemistry.

Ly et al.Automated Reagent-Dispensing System for Microfluidic Cell Biology Assays;Dept of Bioengineering, Samueli School of Engineering & Applied Sciences,Univ of California,Los Angeles, CA, USA,Crump Institute for Molecular Imaging,University of California Los Angeles, CA, USA, Dept of Molecular & Med Pharmacology et al.

Perch-Nielsen R. Ivan et al., A total integrated biochip system for detection of SNP in Cancer, Jan. 11-14, 2010, Proceedings of the 3rd International Conference on the development of BME.

Rocker Scientific Co. Ltd.; Rocker products; Filtration apparatus/VF11 product sheet.

Tian Qingchang et al., An integrated temporary negative pressure assisted microfluidic chip for DNA isolation and digital PCR detection, Sep. 14, 2015, RSC Advances.

Welch David et al., Real-time feedback control of pH within microfluidics using integrated sensing and actuation, Jan. 23, 2014, Lab on Chip.

Xu et al. A self-contained polymeric cartridge for automated biological sample preparation; Institute of Bioengineering and Nanotechnology, 31 Biopolis Way, The Nanos, Singapore 138669.

Zheng et al. Micro-reagent Dispensing Method Based on Pulse Driving & Controlling of Micro-fluids Technology and Application Research; School of Mechanical Engineering, Nanjing University of Science and Technology, Nanjing 210094, China.

Zhou Hongbo et al., "A facile on-demand droplet microfluidic system for lab-on-a-chip applications", Microfluid Nanofluid 2014 16:667-675.

* cited by examiner

DROPLET EJECTORS TO PROVIDE FLUIDS TO DROPLET EJECTORS

BACKGROUND

Droplet ejection is used for a variety of purposes, such as printing ink dispensing of other types of fluid to a target surface. A target surface is often paper or a paper-like substance that absorbs ejected droplets of fluid and forms a final product.

DETAILED DESCRIPTION

Ejection of fluid droplets directly to a final surface is a typical but limited application of droplet ejectors. The use of droplet ejectors has been generally confined to the final stages of fluid delivery processes.

Droplet ejectors may be used in initial and intermediate stages of fluid delivery processes. A droplet ejector may be used to deliver chemical, biological, or biochemical reagents to a target medium, where the target medium feeds a subsequent droplet ejector. The subsequent droplet ejector may be used to eject droplets to a subsequent target medium. A multi-stage or cascading arrangement of droplet ejectors and target media may be implemented.

A given target medium may be fed by multiple droplet ejectors that eject different fluids. A funnel may be used to collect and guide droplets from multiple droplet ejectors. A given set of droplet ejectors may feed multiple target media.

Multiple target media may be connected by a channel for fluid flow independent of inbound or outbound droplet ejection.

In an example application, polymerase chain reaction (PCR) reagents including a sample may be ejected to a first target medium that performs target purification of a fluid containing deoxyribonucleic acid (DNA) or ribonucleic acid (RNA). Fluid in the first target medium may be ejected to a second target medium that performs amplification. Accordingly, a PCR process may be performed using multiple stages of droplet ejection.

In another example application, different colors or compositions of ink may be ejected to first target medium that performs mixing. Mixed ink in the first target medium may then be ejected to a print medium to perform color printing.

Figure 1:
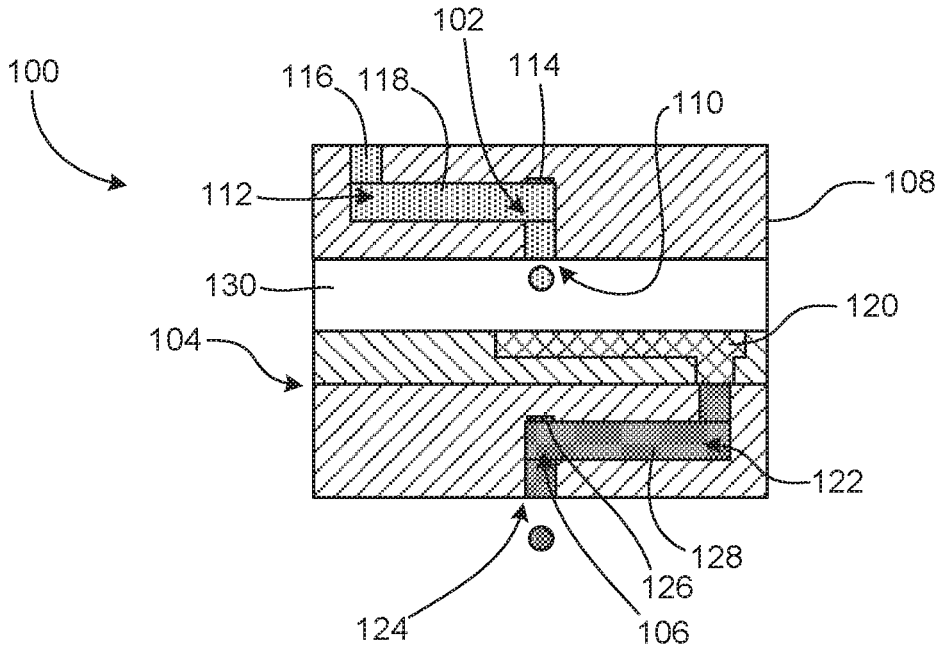
FIG. 1 is a cross-sectional view of an example device with a droplet ejector to provide fluid to another droplet ejector.

FIG. 1 shows an example device 100. The device 100 includes a first droplet ejector 102, a first target medium 104, and a second droplet ejector 106.

The first droplet ejector 102 may be formed at a substrate 108 and such a substrate may have multiple layers. The substrate 108 may include silicon, glass, photoresist, conductive thin film, dielectric thin film, complementary metal-oxide-semiconductor (CMOS) structures or components, other types of electronic structures or devices to enable microfluidic operations, and similar materials. Any number of first droplet ejectors 102 may be provided to a droplet ejection device, which may be referred to as a reagent dispenser or consumable, and such a device may employ inkjet droplet jetting techniques, such as thermal inkjet (TIJ) jetting.

The first droplet ejector 102 includes a first nozzle 110 to eject droplets of a first fluid 112. The first droplet ejector 102 may include a first jet element 114, such as a resistive heater, a piezoelectric element, or similar. The first jet element 114 may be controllable to generate a pressure drop to draw first fluid from a first inlet 116 and through a first channel 118 that feeds the first droplet ejector 102, so as to jet droplets of the first fluid 112 through the first nozzle 110, which may define an orifice or similar fluid output feature.

The first target medium 104 is positioned relative to the first droplet ejector 102 to receive the droplets of the first fluid 112 from the first droplet ejector 102. The first target medium 104 may be spaced apart from the first droplet ejector 102, such that droplets of the first fluid 112 traverse a gap containing air or other gas.

The first target medium 104 may carry the second droplet ejector 106. The first target medium 104 may include a fluid-processing component 120, such as a passive component, an active component, or a combination of such in fluid communication with the second droplet ejector 106. Such a component 120 may also perform a process, which may be a complete process or a phase of a greater process. A process may be performed with the first fluid 112 provided to the first target medium 104 by the first droplet ejector 102. The first target medium 104 may be provided with a reagent, sample, or similar material to undergo a biological, chemical, or biochemical process with the first fluid 112. The first target medium 104 provides a second fluid 122 to the second droplet ejector 106 and the second fluid 122 may be a result of a process performed at the first target medium 104.

Examples of passive components that may be provided to a target medium include a strip or other structure of porous material, paper, foam, fibrous material, micro-fibers, and similar. A passive component may include a network of microfluidic channels, which may be made of silicon, photoresist (e.g., SU-8), polydimethylsiloxane (PDMS), cyclic olefin copolymer (COC), other plastics, glass, and other materials that may be made using micro-fabrication technologies. A fluid may be conveyed by capillary action by a passive component. In other examples, a passive component may be non-porous. A passive medium may contain a fluid that receives droplets of ejected fluid. That is, droplets of an ejected fluid may be ejected into another fluid that is contained by a passive medium. Similarly, a passive medium may contain a solid compound that receives droplets of ejected fluid. A solid compound may be solid in bulk, may be a powder or particulate, may be integrated into a fibrous material, or similar.

Examples of active components that may be provided to a target medium include a substrate having a mesofluidic or microfluidic structure. An active component may include devices such as a pump, sensor, mixing chamber, channel, heater, reaction chamber, or similar to perform action a fluid.

The second droplet ejector 106 is in fluid communication with the first target medium 104 to receive a second fluid 122 from the first target medium 104. The second droplet ejector 106 includes a second nozzle 124 to eject droplets of the second fluid 122. The second droplet ejector 106 may include a second jet element 126, such as a resistive heater, a piezoelectric element, or similar. The second jet element 126 may be controllable to generate a pressure drop to draw second fluid 122 through a second channel 128 that feeds the second droplet ejector 106, so as to jet droplets of the second fluid 122 through the second nozzle 124, which may define an orifice or similar fluid output feature.

The first and second droplet ejectors 102, 106 may be the same or different. For example, the droplet ejectors 102, 106 may be the same or differ in nozzle size, nozzle shape, volume of ejected droplet, type or size of jet element (e.g., thermal resistor size), among other parameters.

The first and second droplet ejectors 102, 106 may be independently controllable. That is, the first droplet ejector 102 may be operated at a frequency to provide a particular flow rate of first fluid droplets to the first target medium 104, while the second droplet ejector 106 may be operated at the same or different frequency to eject a particular flow rate of second fluid droplets from the first target medium 104. A flow rate may be dynamically controlled, in that it may be varied over time. The first target medium 104 may provide additional fluid to the second droplet ejector 106 and the flow rates of the first and second droplet ejectors 102, 106 may be controlled accordingly.

The first and second droplet ejectors 102, 106 may be operated simultaneously, such that an input of first fluid 112 provides a simultaneous output of second fluid 122. The first and second droplet ejectors 102, 106 may be operated sequentially, with first fluid 112 being delivered to the first target medium 104 before the second fluid 122 is outputted.

A fluid 112, 122 may be a reagent, such as a chemical solution, a sample (e.g., a DNA/RNA sample), or other material. The term "fluid" is used herein to denote a material that may be jetted, such as aqueous solutions, suspensions, solvent solutions (e.g., alcohol-based solvent solutions), oil-based solutions, or other materials.

The first and second fluids 112, 122 may be different. The second fluid may be a product of a process, such as a reaction, performed at the first target medium 104.

The first and second fluids 112, 122 may be chemically, biologically, or biochemically similar, identical, or equivalent but may have a differing characteristic. Example differing characteristics include temperature, viscosity, surface tension, concentration of solids, concentration of surfactants, or similar. For example, the first target medium 104 may be provided with a heater that increases the temperature of the first fluid 112 for ejection as the second fluid 122.

The first target medium 104 may be immovably held with respect to the first droplet ejector 102. A frame 130 or similar structure may be provided to hold the substrate 108 that carries the first droplet ejector 102 and first target medium 104 together. The droplet ejectors 102, 106 and the first target medium 104 may be integrated as a disposable cartridge or similar one-time-use consumable package. A substrate 108 that carries the first droplet ejector 102 may be permanently held together with the first target medium 104 by adhesive, material deposition (e.g., deposition of photoresist onto a silicon substrate), interference or snap fit, over-molding, or similar technique. The same applies to a substrate separate from the first target medium 104 that may be provided to carry the second droplet ejector 106.

In operation, the first fluid 112 is drawn through the first channel 118 and droplets of the first fluid 112 are ejected by the first droplet ejector 102 to the first target medium 104. The first target medium 104 performs its process with the first fluid 112 and provides the resulting second fluid 122 to the second droplet ejector 106. The second droplet ejector 106 ejects droplets of the second fluid 122 to a final surface, another target medium, or similar. As such, the first droplet ejector 102 acts as an initial-stage delivery device for fluid to a subsequent stage of droplet ejection.

Figure 2:
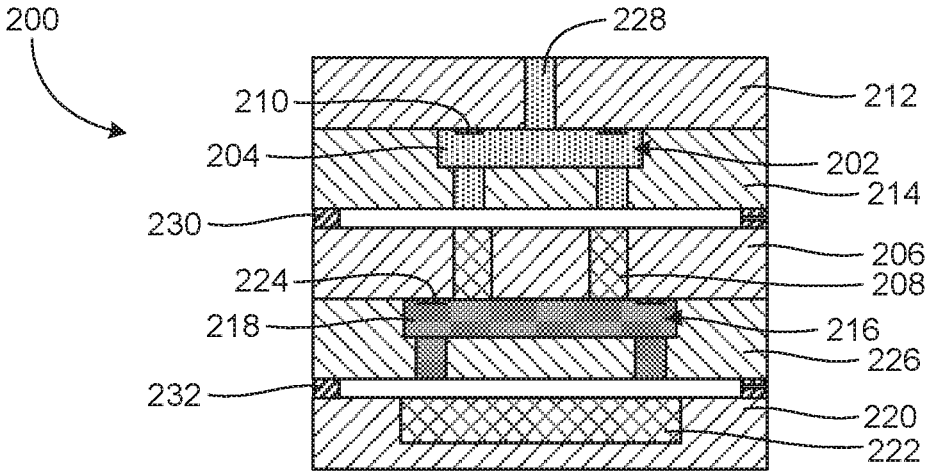
FIG. 2 is a cross-sectional view of an example device with two-stage droplet ejection including a droplet ejector to provide fluid to another droplet ejector.

FIG. 2 shows an example device 200. Features and aspects of the other devices and systems described herein may be used with the device 200 and vice versa. Like reference numerals denote like elements and description of like elements is not repeated here.

The device 200 may be referred to as a multi-stage droplet ejection device. The device 300 may be considered to have two stages.

The device 200 includes a first droplet ejector 202 positioned to eject droplets of a first fluid 204 to a first target medium 206. A plurality of first droplet ejectors 202 may be provided, as illustrated. The positioning of a first droplet ejector 202 may correspond to a first fluid-processing component 208 at the first target medium 206. That is, the first droplet ejector 202 may be aimed towards the first fluid-processing component 208. A quantity of first droplet ejectors 202 may be based on a quantity of first fluid-processing components 208 or may be based on a flow rate of first fluid 204 that may be needed by a fluid-processing component 208.

A first droplet ejector 202 may include a first jet element 210, such as a resistive heater. The first jet element 210 may be disposed on an inlet substrate 212, which may be a silicon substrate. Other structures of the first droplet ejector 202, such as a channel and nozzle, may be formed by building up the substrate, such as by forming a first layer of photoresist 214 (e.g., SU-8 photoresist) on the first silicon substrate 212.

The first target medium 206 may be separated by a gap that droplets of first fluid 204 traverse. The first fluid-processing component 208 may be designed to carry out any suitable process on the first fluid 204 received at the first target medium 206. The fluid-processing component 208 may be structured to feed a second fluid 218, which may result from such process, to a second droplet ejector 216. For example, the fluid-processing component 208 may include a channel that communicates second fluid 218 to the second droplet ejector 216.

The second droplet ejector 216 may be positioned to eject droplets of the second fluid 218 to a second target medium 220 positioned relative to the second droplet ejector 216. A plurality of second droplet ejectors 216 may be provided, as illustrated. The positioning of a second droplet ejector 216 may correspond to a second fluid-processing component 222 at the second target medium 220. That is, the second droplet ejector 216 may be aimed towards the second fluid-processing component 222. A quantity of second droplet ejectors 216 may be based on a quantity of second fluid-processing components 208 or may be based on a flow rate of second fluid 218 that may be needed by a second fluid-processing component 222.

A second droplet ejector 216 may include a second jet element 224, such as a resistive heater. The second jet element 224 may be disposed on the first target medium 206. The first target medium 206 may include a substrate, such as a silicon substrate, on which the second jet element 224 may be formed. Other structures of the second droplet ejector 216, such as a channel and nozzle, may be formed by building up the first target medium 206, such as by forming a second layer of photoresist 226 on the first target medium 206.

The second fluid-processing component 222 may be designed to carry out any suitable process on the second fluid 218 received at the second target medium 220. The process carried out by the second fluid-processing component 222 may continue a process carried out by the first fluid-processing component 208. In other examples, the second fluid-processing component 222 may be a waste collector and the second droplet ejector 216 may be used primarily to generate a pressure drop to draw fluid through the first fluid-processing component 208.

The inlet substrate 212 may be provided with a fluid inlet 228 to feed first fluid into the device 200.

The device 200 may be held together by joining material 230, 232, such as adhesive or gasket material. For example, first joining material 230 may secure the first layer of photoresist 214 and the first target medium 206 together. Second joining material 232 may secure the second layer of photoresist 226 and the second target medium 220 together. Joining material 230, 232 may be gas permeable or may be provided with a gap or opening in communication to the environment outside the device 200, so as to relieve internal positive pressure that may result from ejection of fluid by the droplet ejectors 202, 216.

The joining material 230, 232 may hold the joined components immovable with respect to each other. Joining material 230, 232 may enclose a respective internal volume occupied by fluid droplets in transit, which may reduce a risk of intrusion of contaminants and increase reliability of ejected fluid droplets reaching their target.

Figure 3:
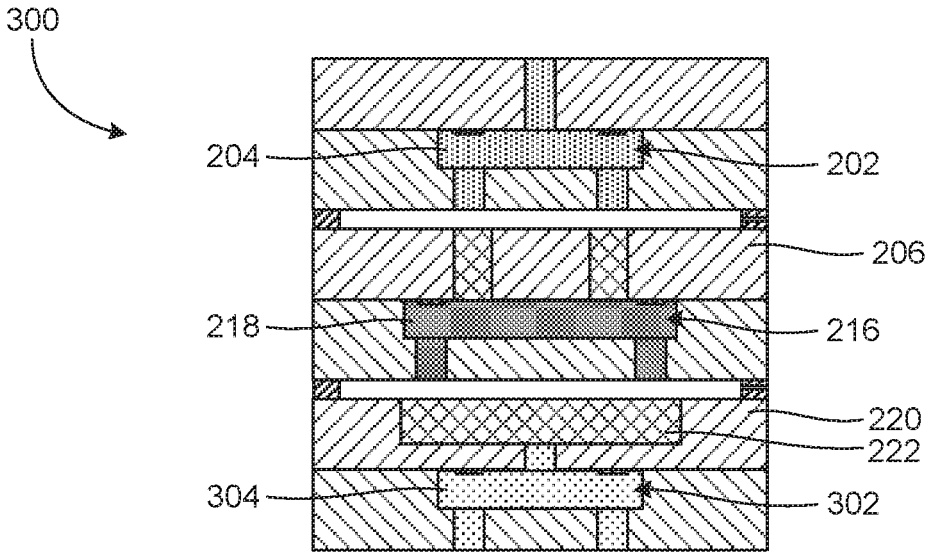
FIG. 3 is a cross-sectional view of an example device with three-stage droplet ejection including a droplet ejector to provide fluid to another droplet ejector.

FIG. 3 shows an example device 300. Features and aspects of the other devices and systems described herein may be used with the device 300 and vice versa. Like reference numerals denote like elements and description of like elements is not repeated here.

The device 300 may be referred to as a multi-stage droplet ejection device. The device 300 may be considered to have three stages.

The device 300 includes a third droplet ejector 302 in fluid communication with a second target medium 220. A plurality of third droplet ejectors 302 may be provided, as illustrated. A third droplet ejector 302 is to receive a third fluid 304 from the second target medium 220, for example, from a second fluid-processing component 222 at the second target medium 220. The third droplet ejector 302 may include a third nozzle to eject droplets of the third fluid 304.

The device 300 may be considered to have three stages: a first stage including a first droplet ejector 202 that ejects a first fluid 204 to a first target medium 206, a second stage including a second droplet ejector 216 that ejects a second fluid 218 to a second target medium 220, and a third stage including a third droplet ejector 304 that ejects a third fluid 304. A third target medium may be provided to receive ejected droplets of the third fluid 304. The third target medium may include a fluid-processing component, a waste collector, or similar. The third droplet ejector 302 may be used primarily to generate a pressure drop to draw fluid through the second fluid-processing component 222 at the second target medium 220.

It should be apparent that four or more stages may be readily implemented. A quantity of stages is not particularly limited.

Figure 4:
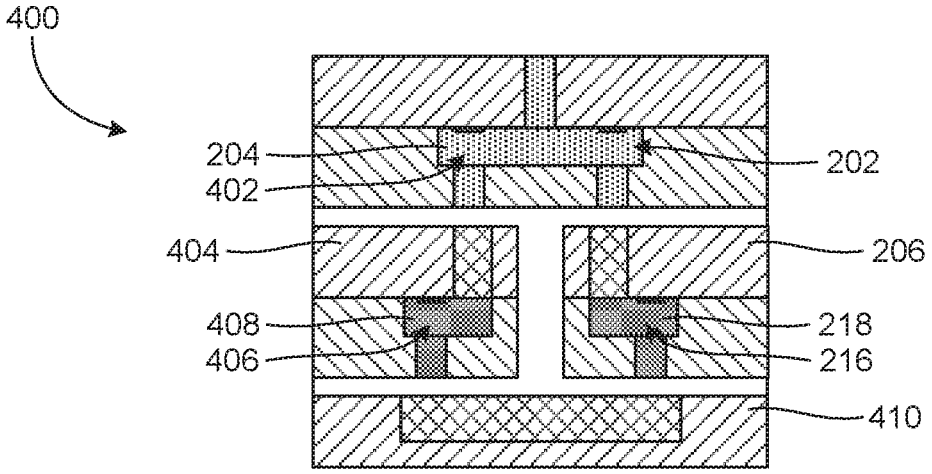
FIG. 4 is a cross-sectional view of an example device with split-stage droplet ejection including a droplet ejector to provide fluid to another droplet ejector.

FIG. 4 shows an example device 400. Features and aspects of the other devices and systems described herein may be used with the device 400 and vice versa. Like reference numerals denote like elements and description of like elements is not repeated here.

The device 400 may be referred to as a multi-stage droplet ejection device. The device 400 may be considered to have split stages.

A plurality of first droplet ejectors 202, 402 are positioned to eject droplets of a first fluid 204 to different target media 206, 404. The different target media 206, 404 may include a first target medium 206 and a second target medium 404. The different target media 206, 404 may provide fluid-processing components to implement separate processing of the first fluid 204, which may be the same processing or different processing.

The target media 206, 404 may include or otherwise be in fluid communication with a plurality of droplet ejectors 216, 406. For example, the first target medium 206 may feed a second fluid 218 resulting from its processing of the first fluid 204 to a second droplet ejector 216. Similarly, the second target medium 404 may feed a third fluid 408 resulting from its processing of the first fluid 204 to a third droplet ejector 406. The droplet ejectors 216, 406 may eject their respective fluids 218, 408 to a subsequent target medium 410, which may include a fluid-processing component, a waste collector, or similar. That is, the subsequent target medium 410 may receive different fluids 218, 408 from different droplet ejectors 216, 406.

A subsequent droplet ejector may be provided to the subsequent target medium 410 to eject fluid from the subsequent target medium 410.

Accordingly, the device 400 may provide for a branching process or two distinct processes using the same first fluid 204. Branches may be split and joined. A splitting branch splits fluid flow in the downstream direction to provide fluid to different droplet ejectors that may have different target media. A joining branch combines separate fluid flows in the downstream direction to collect potentially different fluids for common ejection at a downstream droplet ejector.

Figure 5:
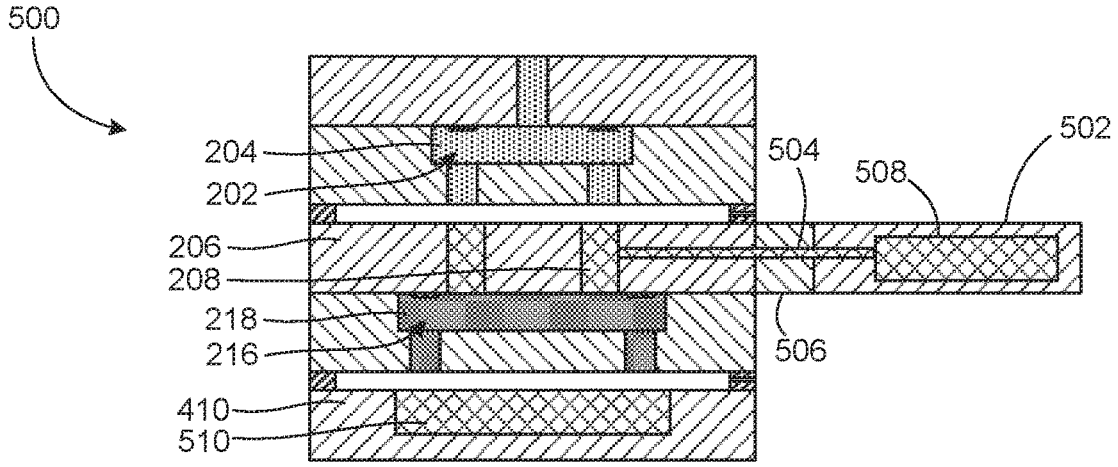
FIG. 5 is a cross-sectional view of an example device with an intermediate branch of fluid flow between stages of droplet ejection.

FIG. 5 shows an example device 500. Features and aspects of the other devices and systems described herein may be used with the device 500 and vice versa. Like reference numerals denote like elements and description of like elements is not repeated here.

The device 500 may be referred to as a multi-stage droplet ejection device. The device 500 may be considered to have an intermediate branch.

The device 500 includes a first droplet ejector 202 that ejects a first fluid 204 to a first target medium 206. The first target medium 206 may include a first fluid-processing component 208 to carry out any suitable process on the first fluid 204 received at the first target medium 206.

The device 500 further includes a second target medium 502 and a channel 504 that fluidly communicates the second target medium 502 with the first target medium 206 at, for example, the first fluid-processing component 208. A channel body 506 may be positioned between the target media 206, 502 and may partially define the channel 504.

The second target medium 502 may include a second fluid-processing component 508 to carry out any suitable process on fluid received via the channel 504.

The device 500 may further include a second droplet ejector 216 to which the first target medium 206 provides second fluid 218. The second droplet ejector 216 may eject droplets of the fluid 218 to a subsequent target medium 410, which may include a fluid-processing component 510, a waste collector, or similar.

Figure 6:
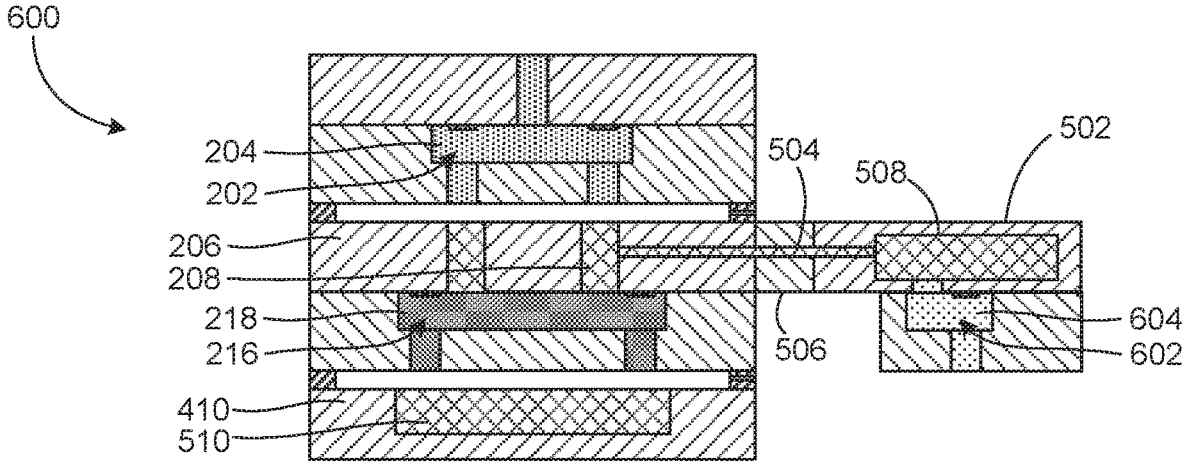
FIG. 6 is a cross-sectional view of an example device with an intermediate branch feeding an additional stage of droplet ejection.

FIG. 6 shows an example device 600. Features and aspects of the other devices and systems described herein may be used with the device 600 and vice versa. Like reference numerals denote like elements and description of like elements is not repeated here.

The device 600 is similar to the device 500 and only differences will be described here. The device 600 includes a third droplet ejector 602 in fluid communication with the second target medium 502 to receive a third fluid 604 from the second target medium, for example, as output of a second-fluid processing component 508. The third droplet ejector 602 includes a third nozzle to eject droplets of the third fluid 604. A plurality of third droplet ejectors 602 may be provided. Ejection of droplets of the third fluid 604 may be aimed towards an additional target medium, may be to draw fluid through the second fluid-processing component 508, or may serve another purpose.

Figure 7:
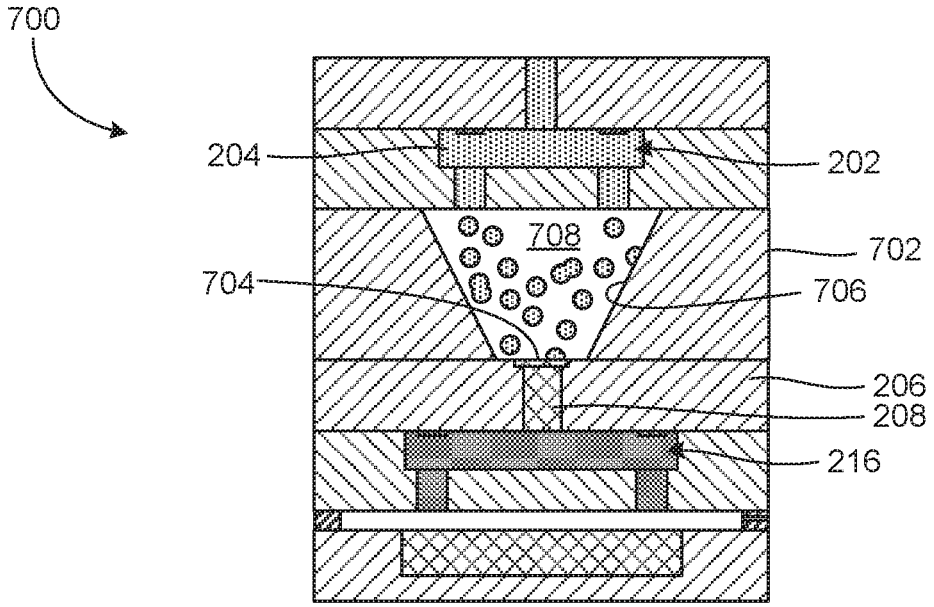
FIG. 7 is a cross-sectional view of an example device with a funnel positioned between droplet ejectors.

FIG. 7 shows an example device 700. Features and aspects of the other devices and systems described herein may be used with the device 700 and vice versa. Like reference numerals denote like elements and description of like elements is not repeated here.

The device 700 is similar to the device 200 and only differences will be described here. The device 700 includes a funnel 702 positioned between a first droplet ejector 202 and a first target medium 206

The funnel 702 is to guide flow of first fluid 204 to a target region 704 on the first target medium 206. The target region 704 may be a fluid input region of a first fluid-processing component 208 of the first target medium 206.

The funnel 702 may act as a frame that affixes first target medium 206 to a substrate that carries the first droplet ejector 202. The funnel 702 may hold the first target medium 206 and the first droplet ejector 202 immovable with respect to one another.

The funnel 702 may include an internal funnel surface 706 that defines an internal droplet volume 708 to contain the fluid droplets ejected by the first droplet ejector 202. In the view shown, two opposing funnel surfaces 706 are depicted. The funnel surface 706 may be flat or curved and may generally narrow from first droplet ejector 202 towards the first target medium 206. The funnel surface 706 may guide droplets in flight and coalesced droplets as liquid towards a target region 704 on the first target medium 206.

The funnel 702 may define an internal droplet volume 708 that is to contain droplets ejected by the first droplet ejector 202 as the droplets traverse a gap between the nozzle of the first droplet ejector 202 and the first target medium 206. The funnel 702 may enclose the internal droplet volume 708, which may reduce a risk of intrusion of contaminants and increase reliability of ejected fluid reaching the target region 704.

Opposing internal funnel surfaces 706 may narrow along the length of the gap between the nozzle of the first droplet ejector 202 and the first target medium 206. The funnel may or may not be symmetrical.

The funnel 702 may be particularly useful in collecting droplets ejected by a plurality of droplet ejectors 102 that may be arranged in an array, grid, or other arrangement and therefore may not be aimed directly towards the target region 704 on the first target medium 206.

In various examples, a funnel may be provided to any stage of droplet ejection, such as a stage that includes a second droplet ejector 216 to direct fluid to a second target medium.

Figure 8:
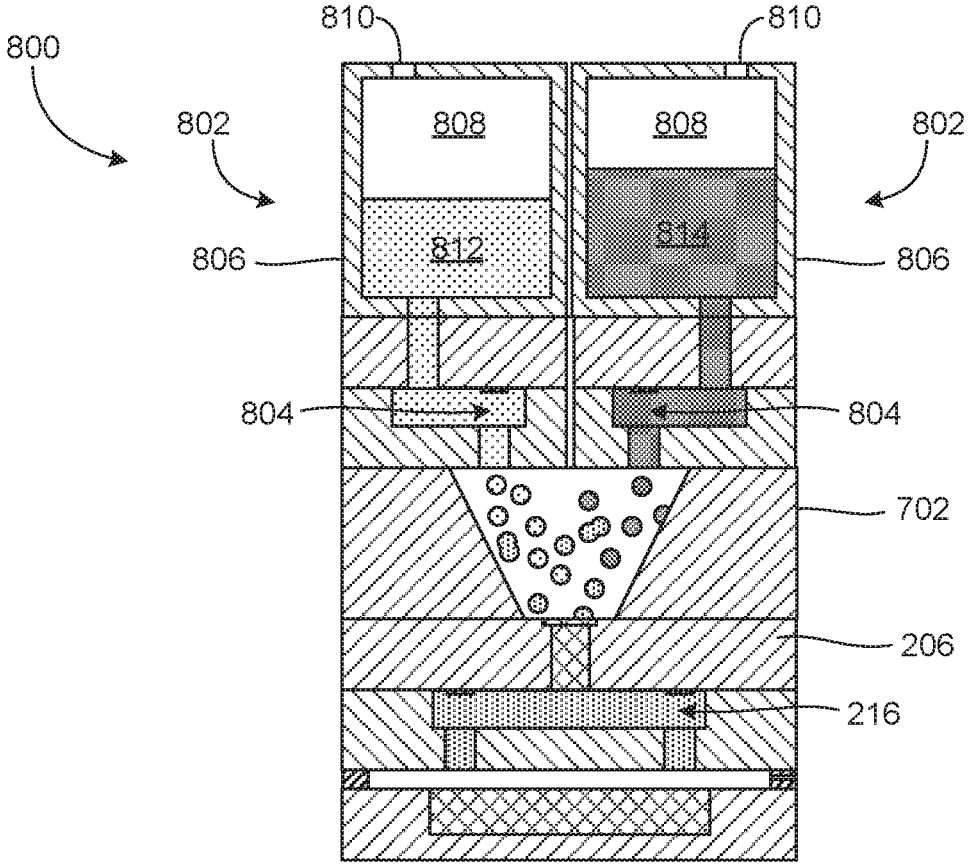
FIG. 8 is a cross-sectional view of an example device with fluid reservoirs and a funnel positioned between droplet ejectors.

FIG. 8 shows an example device 800. Features and aspects of the other devices and systems described herein may be used with the device 800 and vice versa. Like reference numerals denote like elements and description of like elements is not repeated here.

The device 800 is similar to the device 700 and only differences will be described here.

The device 800 includes a plurality of fluid ejection units 802. Different fluid ejection 802 units may be used to provide different fluids to a downstream stage. A fluid ejection unit 802 may include a first droplet ejector 804 in fluid communication with a fluid reservoir 806 that defines an internal fluid volume 808 to contain a fluid. The fluid reservoir 806 may have any suitable dimension, volume, form, or shape.

A fluid reservoir 806 may include a fill port to allow filling of fluid after manufacture, just prior to use, or in similar situations. For example, the device 800 may provide for the analysis of a biological sample and a fill port may be used to provide the sample to the device 800.

A fluid reservoir 806 may include a vent to allow outside air or other gas to enter the fluid reservoir 806 as fluid is ejected, so as to relieve negative pressure that may be caused by fluid being drawn from the respective fluid reservoir 806. The vent may include an opening, a permeable membrane, a bubbler, or similar structure that may resist the intrusion of outside contaminants while allowing for pressure equalization. A fill port may act as a vent.

An example fill port or vent is shown at 810.

Different fluids 812, 814 may be provided to different fluid reservoirs 806 to feed different first droplet ejectors 804. Droplets of fluid 812, 814 may be collected and mixed by a funnel 702 prior to being conveyed to a first target medium 206, may be delivered to different target regions of the first target medium 206, or may be otherwise provided to the first target medium 206.

A second droplet ejector 216 in communication with the first target medium 206 may be provided to eject droplets of fluid conveyed from the first target medium 206.

A fluid reservoir 806 may be provided to any stage of a device to supply fluid to any number of communicating droplet ejectors. When a plurality of fluid reservoirs is provided, different fluid reservoirs may have different dimensions, volumes, forms, or shapes.

Figure 9:
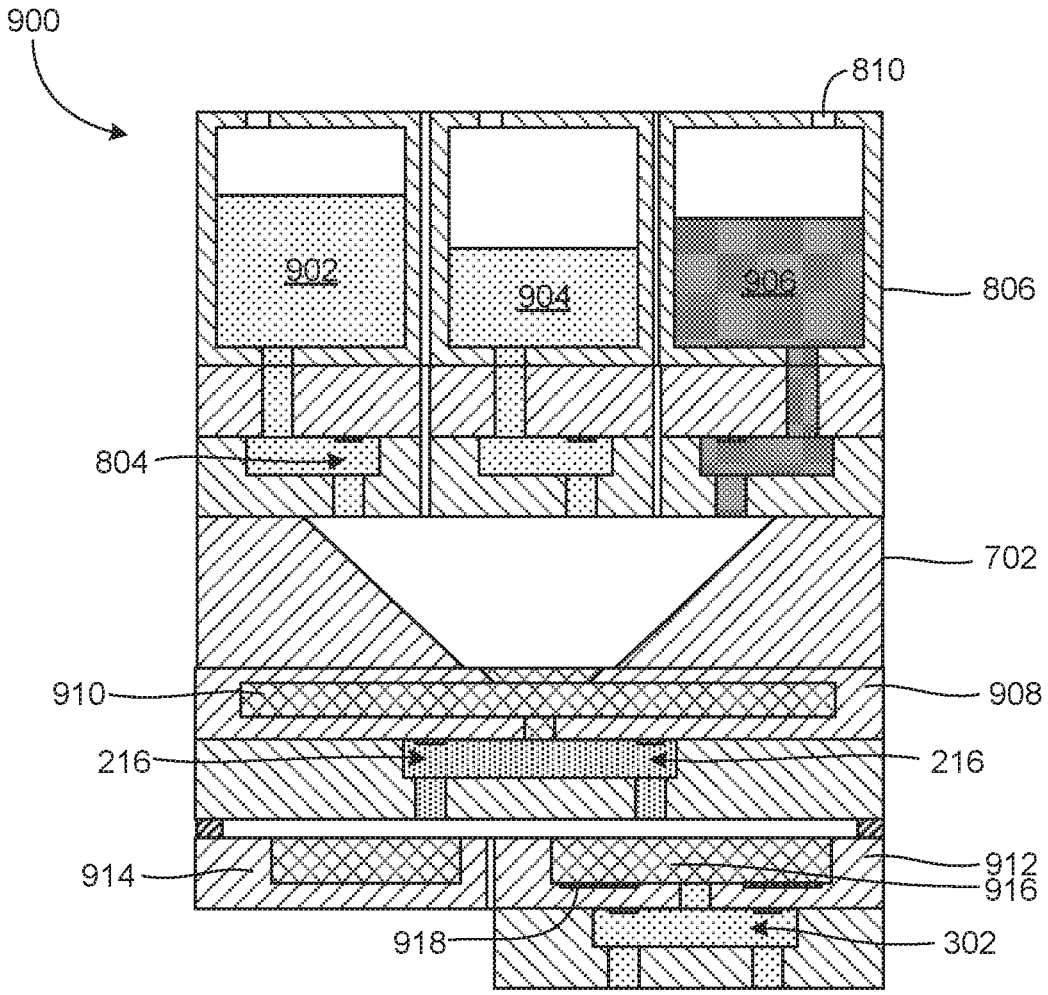
FIG. 9 is a cross-sectional view of an example device with multi-stage droplet ejection that may be used for nucleic acid amplification.

FIG. 9 shows an example device 900. Features and aspects of the other devices and systems described herein may be used with the device 900 and vice versa. Like reference numerals denote like elements and description of like elements is not repeated here.

The device 900 includes a plurality of first droplet ejectors 804 to eject a plurality of different fluids 902, 904, 906, which may be stored in different reservoirs 806. In some examples, the fluids 902, 904, 906 are reagents for a nucleic acid amplification (NAT) process such as a PCR process. A fluid 906 may contain a DNA/RNA sample to be amplified and such sample may be provided via a fill port 810.

The fluids 902, 904, 906 may be ejected at controlled rates by the first droplet ejectors 804 into a funnel 702 that directs the fluids 902, 904, 906 to a target region at a first target medium 908.

The first target medium 908 may include a first fluid-processing component 910 to perform a DNA/RNA purification process.

The first target medium 908 may output fluid resulting from the DNA/RNA purification process to a plurality of second droplet ejectors 216. Channels or other structures that feed fluid to the second droplet ejectors 216 may be structured to provide a target molecule to a second droplet ejector 216 that ejects to a second target medium 912. Fluid that does not contain the target molecule may be ejected to a waste collector 914.

The second target medium 912 may include a second fluid-processing component 916 to perform a DNA/RNA amplification process. The second fluid-processing component 916 may include a heater 918 to perform thermal cycling that may be used in the amplification process. The second fluid-processing component 916 may include a component, such as an electrode, to perform a measurement on a fluid resulting from the amplification process.

The second target medium 912 may output fluid resulting from the amplification process to a third droplet ejector 302. The third droplet ejector 302 may serve to generate a pressure drop to draw fluid through the second target medium 912. The third droplet ejector 302 may eject droplets of fluid to a waste collector, a subsequent target medium to perform a measurement, or similar.

Figure 10:
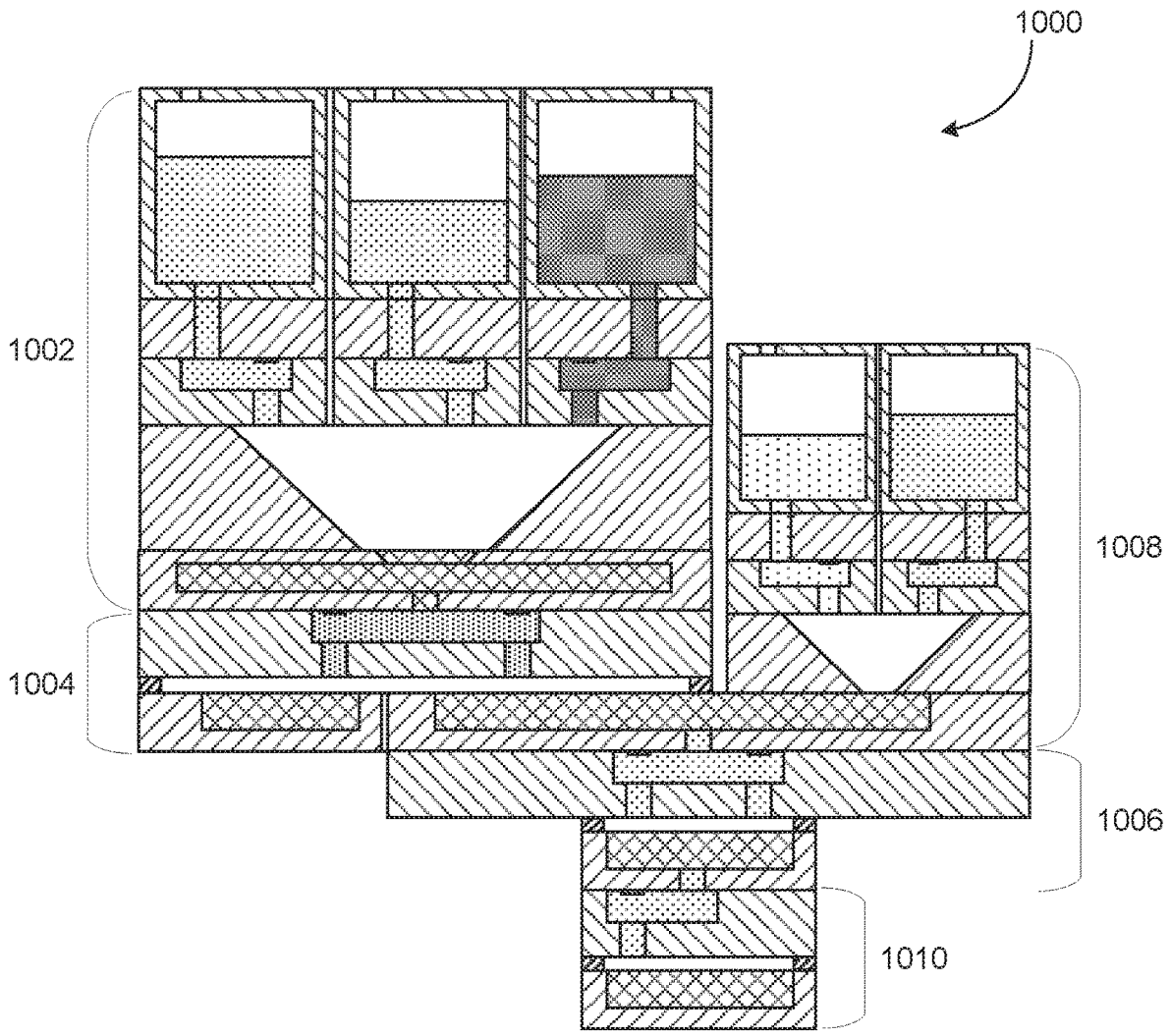
FIG. 10 is a cross-sectional view of an example device to illustrate multi-stage or cascading droplet ejection.

FIG. 10 shows an example device 1000. Features and aspects of the other devices and systems described herein may be used with the device 1000 and vice versa. Like reference numerals denote like elements and description of like elements is not repeated here.

The device 1000 illustrates a complex a multi-stage or cascading arrangement. Numerous similar arrangements are possible. The techniques described herein may be combined to implement microfluidic devices having flow paths of any degree of complexity. This may support the performance of complex processes and reactions.

The device 1000 include a first stage 1002 that ejects droplets of different fluids to a second stage 1004. The second stage 1004 receives fluid from the first stage 1002 and splits ejection of fluid between a waste collector and a fourth stage 1006. A third stage 1008 ejects droplets of different fluids to a target medium shared with the second stage 1004. The fourth stage 1006 receives fluid from both the second and third stages 1004, 1008 and provides fluid to a fifth stage 1010, which may include a waste collector. Each stage may include fluid processing to perform an overall function implemented by the device 1000.

Figure 11:
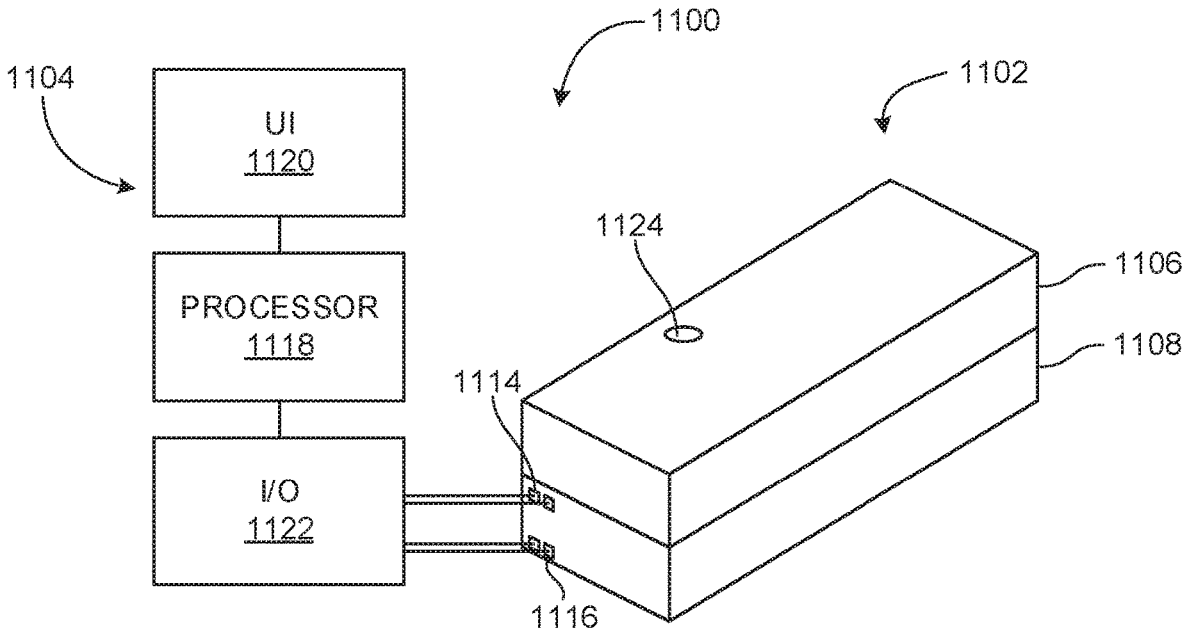
FIG. 11 is a schematic view of an example system including an example control device and an example cartridge including a multi-stage arrangement of droplet ejectors and target media.

FIG. 11 shows an example system 1100. Features and aspects of the other devices and systems described herein may be used with the system 1100 and vice versa. Like reference numerals denote like elements and description of like elements is not repeated here.

The system includes a cartridge 1102 and a control device 1104. The cartridge 1102 may be a disposable cartridge that may be discarded after use.

The disposable cartridge 1102 may be similar or identical to any of the devices described elsewhere herein. The disposable cartridge 1102 may include a fluid reservoir 1106 and a multi-stage arrangement 1108 of droplet ejectors and target media. The fluid reservoir 1106 may feed a fluid to the multi-stage arrangement 1108. The multi-stage arrangement 1108 may include any of the arrangement shown in FIGS. 1-10, for example. Any quantity and combination of fluid reservoirs 1106 and multi-stage arrangements 1108 may be provided.

The multi-stage arrangement 1108 may include a waste collector positioned with respect to a final stage of droplet ejection. A waste collector may include an absorbent material, such as fibers, sponge, or similar, to collect fluid.

A terminal 1114 may be provided to the multi-stage arrangement 1108 to connect jet elements of the droplet ejectors to the control device 1104. The control device 1104 may provide a drive signal to the terminal 1114 to drive the droplet ejectors at the multi-stage arrangement 1108 to eject fluid droplets.

Another terminal 1116 may be provided to the multi-stage arrangement 1108 to connect a sensor at the multi-stage arrangement 1108 to the control device 1104. The control device 1104 may receive from the terminal 1116 a measurement signal indicative of a process carried out at the disposable cartridge 1102.

The control device 1104 may include a processor 1118, a user interface 1120, and an input/output interface 1122.

The user interface 1120 may be connected to the processor 1118 and may include a display, touchscreen, keyboard, or similar to provide output to a user and receive input from the user.

The input/output interface 1122 may be connected to the processor 1118 to provide signal communications between the disposable cartridge 1102 and the processor 1118. The input/output interface 1122 may receive a removeable connection to the terminals 1114, 1116 of the disposable cartridge 1102.

The processor 1118 may include a central processing unit (CPU), a microcontroller, a microprocessor, a processing core, a field-programmable gate array (FPGA), and/or similar device capable of executing instructions. The processor 1118 may cooperate with a non-transitory machine-readable medium that may be an electronic, magnetic, optical, and/or other physical storage device that encodes executable instructions. The machine-readable medium may include, for example, random access memory (RAM), read-only memory (ROM), electrically-erasable programmable read-only memory (EEPROM), flash memory, a storage drive, an optical disc, and/or similar.

The processor 1118 may control the disposable cartridge 1102 to carry out its function by controlling a number of droplet ejectors to activate, a time of droplet ejection by a droplet ejector, a frequency of droplet ejection of a droplet ejector, a combination of such, or similar. The processor 1118 may execute a program by selectively driving droplet ejectors of the multi-stage arrangement 1108. The processor 1118 may receive output of the process carried out at the disposable cartridge 1102 as a signal that may be used to further control the process at the disposable cartridge 1102 or that may be outputted to the user at the user interface 1120.

A process performed at the multi-stage arrangement 1108 may be dynamic or time dependent, and the processor 1118 may vary droplet ejector output over time.

The control device 1104 may control the functionality of a variety of different disposable cartridges 1102.

The control device 1104 may include a mechanical feature to removably mechanically receive a disposable cartridge 1102 by way of a mating mechanical feature at the disposable cartridge 1102.

A fluid reservoir 1106 of the disposable cartridge 1102 may be preloaded with a fluid. A fluid reservoir 1106 of the disposable cartridge 1102 may include a fill port 1124 to receive a fluid from an external source, such as a pipette, syringe, or other fluid delivery device. For example, a generic cartridge may be provided for wide range of usage. Then, a particular end user may add their particular fluid of interest, such as a DNA/RNA sample, to such a cartridge.

Figure 12:
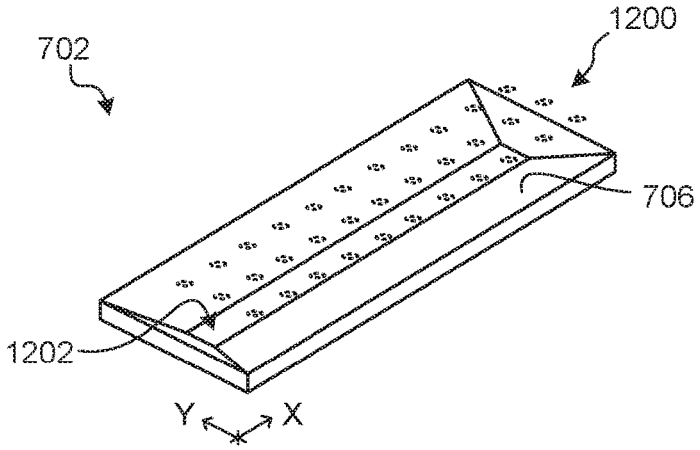
FIG. 12 is a perspective diagram of an example funnel to provide a mixing volume between stages of droplet ejectors.

FIG. 12 shows a perspective view of an example funnel 702 showing an array of droplet ejector nozzles 1200. As shown, the funnel 702 may be used to collect and mix fluid ejected from a plurality of droplet ejectors and direct the resulting mixture to a funnel outlet 1202 that may be positioned at a target region of a target medium.

The funnel 702 may be particularly useful in collecting droplets ejected by the array of droplet ejector nozzles 1200, which may not all be aimed directly towards a target region on a target medium.

The array of droplet ejector nozzles 1200 may be situated in an XY plane defined by the substrate in which the droplet ejectors are formed. A pitch of droplet ejectors in either or both the X and Y directions may be limited by manufacturing constraints. A target maximum flow rate of fluid for a device as a whole may be achieved by increasing a number of droplet ejectors and decreasing ejector spacing to an extent possible. Each droplet ejector may have its own maximum flow rate for a given fluid and a total flow capacity may be determined by summing the individual maximum flow rates for a plurality of ejectors. A particular group of nozzles, such as a row of nozzles in the X direction, may be connected to a particular fluid reservoir. As such, maximum flow rate of a particular fluid may be selected by selecting the number of connected nozzles. A ratio of maximum flow rates of different fluids may correspond to a ratio of the number of respective nozzles providing such fluids. Relatively large-scale mixing may be achieved by using a suitable number of nozzles.

A group of nozzles connected to the same fluid reservoir may be arranged in a row along an X axis, in a row along an Y axis, in a square or other geometry in the XY plane, or similar. This may be useful when mixing different volumes of fluids, particularly when the different volumes differ greatly. For instance, a single nozzle that ejects a first fluid may be surrounded by a square arrangement of eight nozzles that eject a second fluid, and this may provide a nominal 8-to-1 mixing ratio.

In view of the above, it should be apparent that droplet ejectors may be used to feed fluid to downstream droplet ejectors in various quantities and staged or cascading arrangements. Various arrangements may provide for scalability for a quantity of reagents and reagent volumes. Flexibility in reagent delivery protocol may be increased, in that an arbitrary sequence of reagents may be delivered to any quantity of targets. Further, various complex reagent-delivery and bio-processing microfluidic processes may be implemented.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. A device comprising:

a plurality of first droplet ejectors individually including a first nozzle to eject droplets of a first fluid;

multiple target media including a first target medium positioned relative to the first droplet ejector to receive the droplets of the first fluid from the first droplet ejector; and a second droplet ejector in fluid communication with the first target medium to receive a second fluid from the first target medium, the second droplet ejector including a second nozzle to eject droplets of the second fluid.

2. The device of claim 1, further comprising a second target medium positioned relative to the second droplet ejector to receive the droplets of the second fluid from the second droplet ejector.

3. The device of claim 2, further comprising a third droplet ejector in fluid communication with the second target medium to receive a third fluid from the second target medium, the third droplet ejector including a third nozzle to eject droplets of the third fluid.

4. The device of claim 2, further comprising a channel that fluidly communicates the second target medium with the first target medium.

5. The device of claim 4, further comprising a third droplet ejector in fluid communication with the second target medium to receive a third fluid from the second target medium, the third droplet ejector including a third nozzle to eject droplets of the third fluid.

6. The device of claim 1, further comprising a funnel positioned between the first droplet ejector and the first target medium, the funnel to guide flow of the first fluid to a target region on the first target medium.

7. A device comprising:

a first droplet ejector including a first nozzle to eject droplets of a first fluid;

a first target medium positioned relative to the first droplet ejector to receive the droplets of the first fluid from the first droplet ejector;

a second droplet ejector in fluid communication with the first target medium to receive a second fluid from the first target medium, the second droplet ejector including a second nozzle to eject droplets of the second fluid;

a second target medium positioned relative to the second droplet ejector to receive the droplets of the second fluid from the second droplet ejector; and a third droplet ejector in fluid communication with the second target medium to receive a third fluid from the second target medium, the third droplet ejector including a third nozzle to eject droplets of the third fluid.

8. The device of claim 7, further comprising a channel that fluidly communicates the second target medium with the first target medium.

9. The device of claim 7, further comprising a funnel positioned between the first droplet ejector and the first target medium, the funnel to guide flow of the first fluid to a target region on the first target medium.

10. A device comprising:

a first droplet ejector including a first nozzle to eject droplets of a first fluid;

a first target medium positioned relative to the first droplet ejector to receive the droplets of the first fluid from the first droplet ejector;

a second droplet ejector in fluid communication with the first target medium to receive a second fluid from the first target medium, the second droplet ejector including a second nozzle to eject droplets of the second fluid;

a second target medium positioned relative to the second droplet ejector to receive the droplets of the second fluid from the second droplet ejector; and a channel that fluidly communicates the second target medium with the first target medium.

11. The device of claim 10, further comprising a third droplet ejector in fluid communication with the second target medium to receive a third fluid from the second target medium, the third droplet ejector including a third nozzle to eject droplets of the third fluid.

12. The device of claim 10, further comprising a funnel positioned between the first droplet ejector and the first target medium, the funnel to guide flow of the first fluid to a target region on the first target medium.

* * * * *